US005932400A

United States Patent [19]

Fujii et al.

[11] Patent Number: 5,932,400

[45] Date of Patent: Aug. 3, 1999

[54] ODORLESS FIXING SOLUTION

[75] Inventors: Gary Fujii; Dewey R. Fujii, both of Torrance, Calif.

[73] Assignee: Varichem Corporation, Los Angeles, Calif.

[21] Appl. No.: 09/026,825

[22] Filed: Feb. 19, 1998

[51] Int. Cl.[6] ..... G03C 5/38

[52] U.S. Cl. ..... 430/455; 430/432

[58] Field of Search ..... 430/455

[56] References Cited

U.S. PATENT DOCUMENTS

| | | | |
|---|---|---|---|
| 2,295,734 | 9/1942 | Holzworth | 430/455 |
| 5,629,138 | 5/1997 | Faranda et al. | 430/455 |

FOREIGN PATENT DOCUMENTS

| | | |
|---|---|---|
| 4019739 | 1/1992 | Japan . |
| 5127323 | 5/1993 | Japan . |

OTHER PUBLICATIONS

Haist, G. "Acid Hardening Thiosulfate Fixing Baths" Modern Photographic Processing vol. 2, Chapter 13: 575–576 (1979).

Sheppard, S.E. et al. "Chemistry of the Acid Fixing Bath" J. Frank. Inst. 196: 45–67 (1923).

Wall, E.J. & Jordan, F.I. "Fixing, Washing, and Drying Negatives" Photographic Facts and Formulas Chapter 4: 142–160 (1975).

*Primary Examiner*—Hoa Van Le

*Attorney, Agent, or Firm*—Pillsbury Madison & Sutro LLP

[57] ABSTRACT

The present invention provides an odorless fixing composition for fixing silver halide photographic media. The composition includes ammonium thiosulfate as a halide solubilizing agent and a non-volatile organic acid for pH buffering. Preferably, the acid is glycolic acid, succinic acid, or a derivative thereof. In addition, the present invention provides a method for fixing silver halide photographic media by exposing the developed media to the odorless fixer composition.

17 Claims, No Drawings

ODORLESS FIXING SOLUTION

FIELD OF THE INVENTION

The present invention relates generally to a photographic fixing composition and, more particularly, to a photographic fixing composition that is substantially free of objectionable or unpleasant odors. Accordingly, this invention overcomes a problem that is typical with modern rapid fixing compositions.

BACKGROUND OF THE INVENTION

Acid-based fixing solutions are used for the processing of a variety of photographic media, including, for example, photographic film, photographic paper, and X-ray film. These fixing solutions are typically composed of several components. Usually, the primary agent is a chemical constituent which promotes the solubilization of unexposed silver halide found in many film emulsions. The chemical constituent most commonly used for this purpose is thiosulfate ion. Another important component of acid fixing solutions is a pH buffer which typically is an acid. Acetic acid is the most commonly used pH buffer in commercially available photographic fixing solutions today. The presence of an acidic environment helps to neutralize residual developer chemicals from preceding processing steps and thereby reduces the possibility of development continuing in the fixing bath. Typically, commercial fixing solutions also contain a preservative such as sulfite ion.

Prior to about 1940, most thiosulfate fixing baths used sodium thiosulfate as the silver halide solvent. During this time, studies on pH control of the acid fixing bath were conducted with the aim of stopping further development of the photographic film or paper by neutralizing developer alkali carried over from the developing step into the fixing solution. It was found that acids generally would serve this purpose. Organic acids, such as acetic, formic, oxalic, malic, and diglycolic acid, were found to be satisfactory pH buffers and found to be superior to strong inorganic acids. For many reasons, acetic acid became the acid of choice in maintaining the pH of commercial fixing solutions. At present, many major commercial fixing solutions contain acetic acid/acetate ion buffer to maintain the proper pH.

Since about 1940, ammonium thiosulfate has been used as an alternative to sodium thiosulfate as the silver solvent and is today the most common silver halide solvent used in fixing solutions. This is due in large measure to the discovery that the ammonium ion dramatically increases the speed of fixation by promoting the rate of dissolution of silver halide (Alnutt et al., J.SMPE 1943, 41: 300). Because prior studies had already established the acetic acid/acetate ion buffer as suitable for sodium thiosulfate fixing solutions, formulations containing ammonium thiosulfate have also usually included this buffer.

However, an unpleasant and potentially hazardous problem associated with fixing solutions is the characteristic odor which is caused by the presence of certain volatile compounds. The odor from fixing solutions is a major contributor to the unpleasant smell encountered in photo labs and in "one-hour" photo and film processing shops. The odor originates from both the acetic acid component of the pH buffer and the ammonia that is present in rapid fixing baths containing ammonium thiosulfate. In view of the foregoing, a need exists for a fixing composition which retains most or all of the attributes of prior fixing solutions, but which is essentially devoid of objectionable or unpleasant odors.

SUMMARY OF THE INVENTION

The present invention addresses the problems and concerns of prior art fixing solutions. In the present invention, an odorless photographic fixing composition is provided. The odorless fixing composition of the present invention can be prepared as a ready-to-use solution or as a concentrate that can be diluted (preferably with water) for use in the processing of photographic film and prints. The fixing composition of the present invention is useful in the processing of silver halide photographic media generally and can be used for both color and black and white photographic processing.

In certain preferred embodiments, the composition comprises a non-volatile organic acid, a silver halide solubilizing agent and a preservative. Preferably, the non-volatile organic acid is a carboxylic acid and most preferably is a diprotic or triprotic carboxylic acid. It is also preferred that the silver halide solubilizing agent comprises ammonium thiosulfate and that the preservative comprises a sulfite ion, bisulfite ion, or metabisulfite ion. However, other appropriate solubilizing agents and preservatives may be used.

The odorless fixing composition of the present invention may be mixed with a separate solution containing a hardening agent prior to use or, alternatively, may further include a hardening agent so that a ready-to-use solution is provided without need for mixing. The hardening agent is preferably an aluminum salt such as aluminum chloride, aluminum sulfate, potassium alum, sodium alum, and ammonium alum, although other appropriate hardening agents may be used. Such other hardening agents are known in the art.

Other features and advantages of the present invention will become apparent from the following detailed description and the examples which provide, by way of illustration, certain preferred embodiments.

DETAILED DESCRIPTION OF THE INVENTION

Commercially available photographic fixing compositions possess objectionable or unpleasant odors due to the presence of ammonium thiosulfate and acetic acid. These compounds are the source of the ammonia and vinegar odors, respectively, that are characteristic of existing fixing solutions. Unfortunately, it is not possible to simply eliminate these compounds from fixing compositions, since such compositions require a silver halide solubilizing agent like ammonium thiosulfate and a pH buffering acid like acetic acid. Moreover, while sodium thiosulfate may be substituted, it is significantly inferior to ammonium thiosulfate as a solubilizing agent for silver halide.

It has been discovered by the inventors, however, that certain non-volatile organic acids may be substituted for acetic acid without adversely affecting the pH buffering of the fixing solution. Substitution of these non-volatile organic acids for acetic acid not only eliminates the vinegary odor attributable to acetic acid but, surprisingly, also eliminates the ammonia odor caused by ammonium thiosulfate. Thus, the need for eliminating ammonium thiosulfate or finding an odorless substitute therefor is obviated by the present invention.

Examples of non-volatile organic acids found to be useful in the odorless fixing composition of the present invention include carboxylic acids such as malic, lactic, glycolic, tartaric, citric and succinic acid, and derivatives thereof. Such derivatives include, but are not limited to, monoprotic acids such as glyceric, gluconic and glucoheptonic acid; diprotic acids such as methyl succinic, citramalic, glutaric and glucaric acid; and triprotic acids such as tricarballylic and nitrilotriacetic acid.

The concentration of non-volatile organic acid useful for the present invention is preferably in the range between about 1 gram and about 150 grams per liter. Preferably, the concentration of the organic acid is between 5 grams and about 100 grams per liter and, most preferably, is between about 10 grams and about 75 grams per liter.

The odorless fixing composition of the present invention comprises, in addition to the non-volatile organic acid, a silver halide solubilizing agent. Preferably, the silver halide solubilizing agent comprises one or both of thiosulfate or thiocyanate ion. More preferably, the silver halide solubilizing agent is ammonium thiosulfate and is present at a concentration between about 0.5 mol to about 10 mol per liter. Most preferably, the concentration is between about 1 mol to about 8 mol per liter.

It is preferred that the odorless fixing composition also comprises a preservative such as a sulfite, bisulfite or metabisulfite ion. The sodium or potassium salts of these ions are particularly preferred. The preferred concentration of preservative in the fixing solution is at least about 0.1 mol per liter.

The odorless fixer composition of the present invention preferably has a pH between about 3.0 and about 6.5. More preferably, the pH is between about 4.0 and about 6.0 and, most preferably, is between about 4.7 and about 5.8.

A hardening agent may be included as an ingredient of the odorless fixing composition or may be added to the fixing composition as a separate ingredient. Suitable hardening agents include water-soluble aluminum salts or complexes such as aluminum chloride, aluminum sulfate, and sodium, potassium, or ammonium alum. Addition of a hardening agent is particularly useful for the processing of medical X-ray film.

The odorless fixing composition of the present invention may further be prepared as a ready-to-use solution or as a concentrate that can be diluted either in advance or just prior to use. The concentrate may be diluted (preferably with water) at any ratio where the solution still possesses an appropriate pH and has sufficient neutralizing capacity for residual chemicals from the developing step. Such ratios would be apparent to those skilled in the art or readily ascertained by testing.

The following examples illustrate preferred embodiments of the present invention.

EXAMPLE 1

Fixing compositions containing the components shown in TABLE 1 (in the amounts indicated) were prepared as follows.

Ammonium thiosulfate, sodium bisulfite, borax, sodium hydroxide and sodium gluconate were dissolved in water. Glycolic acid was slowly added with mixing and the resulting mixture was diluted to the volume indicated in TABLE 1.

TABLE 1

ODORLESS FIXING COMPOSITION

| MATERIAL | 1 LITER[1,2] | 1 GALLON[1,2] | LBS. PER 100 GALLONS[1,2] |
|---|---|---|---|
| Ammonium thiosulfate - 60% aq. d = 1.326 | 1066.0 grams (804.0 ml) | 4034 grams (3043.1 ml) | 887.9 lbs. |
| Sodium bisultite, anhydrous; | 65.0 grams | 246 grams | 51.19 lbs. |
| Borax | 29.0 grams | 109.8 grams | 24.18 lbs. |

TABLE 1-continued

ODORLESS FIXING COMPOSITION

| MATERIAL | 1 LITER[1,2] | 1 GALLON[1,2] | LBS. PER 100 GALLONS[1,2] |
|---|---|---|---|
| Sodium hydroxide, bead | 7.8 grams | 27.5 grams | 6.503 lbs. |
| Sodium gluconate | 5.0 grams | 18.9 grams | 4.168 lbs. |
| Glycolic Acid 70 wt. % in water | 37.5 grams (30.0 ml) | 141.9 grams | 31.264 lbs. |
| Water, DI to make up to | 1 liter | 1 gallon | 100 gallons |

[1]The pH of the resulting concentratewas 5.35 +/− 0.05.
[2]The specific gravity of the resulting concentrate was 1.332 +/− 0.005.

EXAMPLE 2

A stock solution of a fixing composition (not containing pH buffer) was prepared by combining the components in TABLE 2 in the amounts specified therein.

TABLE 2

FIXING COMPOSITION WITHOUT A pH BUFFER

| MATERIAL | 7.57 LITERS |
|---|---|
| Ammonium thiosulfate - 60% aq. d = 1.326 | 8070 grams |
| Sodium bisulfite, anhydrous | 492 grams |
| Borax 5 mol. | 220 grams |
| Sodium hydroxide, bead | 140 grams |
| Sodium gluconate | 230 grams |
| Water, DI to make up to | 7.57 liters |

EXAMPLE 3

Five odorless fixing solutions were prepared from the stock solution in Example 2 according to the following procedure. For each solution, 200 ml of the stock solution from TABLE 2 was added to a specified amount of a non-volatile organic acid (see below):

(1) Lactic Acid: 73.3 grams
(2) Tartaric Acid: 61.1 grams
(3) Citric Acid: 52.2 grams
(4) Succinic Acid: 48.0 grams
(5) Glycolic Acid: 61.9 grams Each solution was then mixed and diluted with deionized water to a final volume of 1 liter. The pH of the diluted fixing composition was adjusted to approximately 5.3 to 5.35 using sodium hydroxide (NaOH) and the properties of each fixing composition was evaluated for odor, time to clear film and buffering capacity.

The odor of each fixer was assessed by a panel of seven volunteers who were determined to be sensitive to ammonia and acetic acid odors. Each volunteer was asked whether there was a detectable odor and, if so, whether the odor was from acetic acid or ammonia. Included in the study were two controls: (1) an ammonia control and (2) a fixing solution containing acetic acid.

The efficiency of each fixing composition to solvate silver halide was evaluated by determining the time required to clear or remove the silver halide from a piece of film. The buffering capacity was evaluated by titrating a 50% (w/v) solution of potassium hydroxide (KOH) into each fixing composition. The results from these evaluations are shown in TABLE 3.

TABLE 3

PHYSICAL PROPERTIES OF FIXERS

| | NON-VOLATILE ACID | POSITIVE ODOR (# of positive responses/# of volunteers) | CLEARING TIME OF FILM (SECONDS) | BUFFERING CAPACITY, pH AFTER 8 mL 50% KOH |
|---|---|---|---|---|
| AMMONIA CONTROL | — | 7/7 | — | — |
| CONTROL FIXER | Acetic acid | 7/7 | 6–7 | 7.21 |
| EXAMPLE 2 | Lactic acid | 0/7 | 7–8 | 8.25 |
| EXAMPLE 3 | Tartaric acid | 0/7 | 8 | 8.36 |
| EXAMPLE 4 | Citric acid | 0/7 | 6.5–7 | 8.12 |
| EXAMPLE 5 | Succinic acid | 0/7 | 6–7 | 6.87 |
| EXAMPLE 6 | Glycolic acid | 2/7[1] | 7 | 8.23 |

[1]Two volunteers detected a faint odor that may or may not have been associated with ammonia.

TABLE 3 shows that the addition of a non-volatile organic acid is effective in eliminating or virtually eliminating the ammonia and vinegary odors characteristic of fixing baths while retaining the beneficial and useful properties necessary to be effective as a photographic fixing solution.

As described above, the present invention provides several preferred embodiments. Various modifications and equivalent substitutes may be incorporated without departing from the spirit of the invention, as would be apparent to those skilled in the art. Furthermore, the Examples provided herein are intended to illustrate particular embodiments of the present invention and are not intended to act as a limitation on the scope of the following claims.

What is claimed is:

1. A composition for fixing photographic media comprising silver halide, the fixing composition comprising:

ammonium thiosulfate, in a concentration effective to serve as a silver halide solubilizing agent; and one or more non-volatile organic acids selected from the group consisting of glycolic acid, succinic acid, and derivatives thereof, wherein said acids are substantially the sole non-volatile organic acid agents, wherein the fixing composition has a pH between about 3.0 and about 6.5 and is essentially free of acetic acid.

2. The composition of claim 1, wherein the ammonium thiosulfate concentration is between about 0.5 mol and about 10 mol per liter.

3. The composition of claim 2, wherein the ammonium thiosulfate concentration is between about 1 mol and about 8 mol per liter.

4. The composition of claim 1, wherein the pH is between about 4.0 and about 6.0.

5. The composition of claim 4, wherein the pH is between about 4.7 and about 5.8.

6. The composition of claim 1, further comprising a preservative.

7. The composition of claim 6, wherein the preservative comprises sulfite ion, bisulfite ion, and metabisulfite ion.

8. The composition of claim 6, wherein the preservative is sodium bisulfite.

9. The composition of claim 8, wherein the concentration of sodium bisulfite is at least about 0.1 mol per liter.

10. The composition of claim 1, wherein the organic acid is present at a concentration between about 1 gram and about 150 grams per liter.

11. The composition of claim 10, wherein the organic acid is present at a concentration between about 5 grams and about 100 grams per liter.

12. The composition of claim 11, wherein the organic acid is present at a concentration between 10 grams and about 75 grams per liter.

13. The composition of claim 1, further comprising a hardening agent.

14. The composition of claim 13, wherein the hardening agent is a water-soluble aluminum salt.

15. The composition of claim 14, wherein the aluminum salt is selected from the group consisting of aluminum chloride, aluminum sulfate, potassium alum, sodium alum, and ammonium alum.

16. A method for fixing photographic media comprising silver halide, the method comprising exposing the media to a fixing composition comprising:

ammonium thiosulfate, in a concentration effective to serve as a silver halide solubilizing agent; and one or more non-volatile organic acids selected from the group consisting of glycolic acid, succinic acid, and derivatives thereof, wherein said acids are substantially the sole non-volatile organic acid agents, wherein the composition has a pH between about 3.0 and 6.5 and is essentially free of acetic acid.

17. A method for processing photographic media comprising silver halide, the method comprising:

developing the media in a developer solution and, subsequently, fixing the developed media with a fixing composition comprising:

ammonium thiosulfate, in a concentration effective to serve as a silver halide solubilizing agent; and one or more non-volatile organic acids selected from the group consisting of glycolic acid, succinic acid, and derivatives thereof, wherein said acids are substantially the sole non-volatile organic acid agents, wherein the fixer composition has a pH between about 3.0 and 6.5 and is essentially free of acetic acid.

* * * * *